US005914445A

United States Patent [19]

Binz et al.

[11] Patent Number: 5,914,445

[45] Date of Patent: Jun. 22, 1999

[54] DYEING ASSISTANT PREPARATIONS AND THEIR USE FOR DYEING WOOL

[75] Inventors: Jörg Binz, Aesch; Bruno Saladin, Duggingen, both of Switzerland; Martin Jöllenbeck, Müllheim, Germany

[73] Assignee: Ciba Specialty Chemicals Corporation, Tarrytown, N.Y.

[21] Appl. No.: 08/935,429

[22] Filed: Sep. 23, 1997

Related U.S. Application Data

[62] Division of application No. 08/649,939, May 15, 1996, abandoned.

[30] Foreign Application Priority Data

May 18, 1995 [CH] Switzerland ..... 1478/95

[51] Int. Cl.[6] ..... D06P 3/16; D06P 1/38; D06P 1/645; D06P 1/651

[52] U.S. Cl. ..... 8/543; 8/552; 8/576; 8/609; 8/611; 8/917; 8/685

[58] Field of Search ..... 8/543–549, 685, 8/917, 576, 552, 597, 609, 611

[56] References Cited

U.S. PATENT DOCUMENTS

| | | | |
|---|---|---|---|
| 3,628,905 | 12/1971 | Kirschuck et al. | 8/54 |
| 3,914,185 | 10/1975 | Inamorato | 252/546 |
| 3,928,249 | 12/1975 | Nunziata et al. | 510/341 |
| 4,247,424 | 1/1981 | Kuzel et al. | 510/503 |
| 4,276,205 | 6/1981 | Ferry | 252/528 |
| 4,284,532 | 8/1981 | Leikhim et al. | 252/528 |
| 4,436,653 | 3/1984 | Jacobson et al. | 252/547 |
| 4,594,184 | 6/1986 | Cook et al. | 510/503 |
| 4,935,033 | 6/1990 | Mosimann et al. | 8/543 |
| 5,454,984 | 10/1995 | Graubart et al. | 510/502 |
| 5,474,713 | 12/1995 | Faber | 510/423 |

FOREIGN PATENT DOCUMENTS

| | | |
|---|---|---|
| 2146760 | 3/1973 | Germany . |
| 2220710 | 11/1973 | Germany . |
| 2802304 | 7/1978 | Germany . |
| 4324152 | 1/1995 | Germany . |
| 1370599 | 10/1974 | United Kingdom . |
| 1406814 | 9/1975 | United Kingdom . |

*Primary Examiner*—Margaret Einsmann
*Attorney, Agent, or Firm*—Kevin T. Mansfield; David R. Crichton

[57] ABSTRACT

The present invention relates to novel dyeing assistant preparations comprising, as component (a), at least one amine oxide of the formula

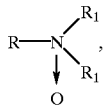

(1)

in which

R is an aliphatic radical having 8 to 24 carbon atoms and $R_1$ is an aliphatic radical which is unsubstituted or substituted by hydroxyl and has 1 to 24 carbon atoms, preferably 1 to 6 carbon atoms, as component (b), at least one compound of the formula $$R_2—U—(R_3—O)_m—W, \quad (2)$$

in which $R_2$ is an aliphatic radical having 8 to 24 carbon atoms, $R_3$ is alkylene having 2 to 4 carbon atoms, U is —O— or

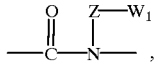

in which Z is a direct bond, $(R_3—O))_r$ or $C_1$–$C_6$alkylene and $W_1$ is hydrogen or $C_1$–$C_6$alkyl which is unsubstituted or substituted by hydroxyl, carboxyl, isocyanato, phenyl, benzyloxymethylene or phenethyloxymethylene, m and r independently of one another are a number from 2 to 25, $(R_3—O)_m$ is m identical or different radicals $(R_3—O)$ and $(R_3—O)_r$ is r identical or different radicals $(R_3—O)$, and W is hydrogen or $C_1$–$C_6$alkyl which is unsubstituted or substituted by hydroxyl, carboxyl, isocyanato, phenyl, benzyloxymethylene or phenethyloxymethylene, and, as component (c), an organic solvent, and to their use as dyeing assistants for dyeing wool.

12 Claims, No Drawings

DYEING ASSISTANT PREPARATIONS AND THEIR USE FOR DYEING WOOL

This is a divisional of application Ser. No. 08/649,939 filed on May 15, 1996, abandoned.

The present invention relates to novel dyeing assistant preparations comprising at least one amine oxide, at least one fatty alcohol glycol ether and/or one fatty acid amide glycol ether and an organic solvent, and to their use as dyeing assistants for dyeing wool.

The use of amine oxides in the presence of fatty alcohol ethoxylates for dyeing wool is known, for example, from DE-A-1 619 530. However, the handling and the incorporation of these dyeing assistants into a dyebath does not meet all the current requirements. There is therefore a need for a finished preparation which is stable and can be added to the dyebath with simple means. The object of this invention was to provide such preparations.

It has now been found, surprisingly, that this object can be achieved with the preparations according to the invention.

The present invention thus relates to dyeing assistant preparations comprising, as component (a), at least one amine oxide of the formula

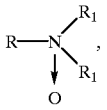

(1)

in which

R is an aliphatic radical having 8 to 24 carbon atoms and $R_1$ is an aliphatic radical which is unsubstituted or substituted by hydroxyl and has 1 to 24 carbon atoms, preferably 1 to 6carbon atoms, as component (b), at least one compound of the formula $$R_2—U—(R_3—O)_m—W, \quad (2)$$

in which $R_2$ is an aliphatic radical having 8 to 24 carbon atoms, $R_3$ is alkylene having 2 to 4 carbon atoms, U is —O—or

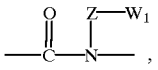

in which Z is a direct bond, $(R_3—O)_r$ or $C_1$–$C_6$alkylene and $W_1$ is hydrogen or $C_1$–$C_6$alkyl which is unsubstituted or substituted by hydroxyl, carboxyl, isocyanato, phenyl, benzyloxymethylene or phenethyloxymethylene, m and r independently of one another are a number from 2 to 25, $(R_3—O)_m$ is m identical or different radicals $(R_3—O)$ and $(R_3—O)_r$ is r identical or different radicals $(R_3—O)$, and W is hydrogen or $C_1$–$C_6$alkyl which is unsubstituted or substituted by hydroxyl, carboxyl, isocyanato, phenyl, benzyloxymethylene or phenethyloxymethylene, and, as component (c), an organic solvent.

Aliphatic radicals R and $R_2$ having 8 to 24 carbon atoms are, for example, $C_8$–$C_{24}$alkyl or $C_8$–$C_{24}$alkenyl, such as octyl, nonyl, decyl, undecyl, dodecyl, tridecyl, tetradecyl, pentadecyl, hexadecyl, heptadecyl, octadecyl, tetradecenyl, hexadecenyl, octadecenyl or naturally occurring mixtures containing several different alkyl or alkenyl radicals, such as tallow fat ($C_{12}$ to $C_{18}$) or coconut fat ($C_8$ to $C_{18}$). Preferably, the aliphatic radicals R and $R_2$ contain 12 carbon atoms (lauryl), 14 carbon atoms (myristyl), 16 carbon atoms (cetyl) or 18 carbon atoms (oleyl, stearyl) or mixtures of 8 to 18 carbon atoms (coconut fat) or 12 to 18 carbon atoms (tallow fat).

An aliphatic radical $R_1$ having 1 to 24 carbon atoms is, for example, methyl, ethyl, n-propyl, isopropyl, n-butyl, isobutyl, sec-butyl, tert-butyl or hydroxyethyl. Methyl and hydroxyethyl are preferred.

Alkylene $R_3$ having 2 to 4 carbon atoms is, for example, propylene, butylene or, preferably, ethylene.

Suitable amine oxides as component (a) are, for example, the following compounds:

N,N-dimethyl-N-dodecylamine oxide, N,N-dimethyl-N-hexadecylamine oxide,

N,N-dimethyl-N-octadecenylamine oxide, N,N-dibutyl-N-dodecylamine oxide,

N,N-bis-(β-hydroxyethyl)-N-stearylamine oxide, N,N-dimethyl-N-oleylamine oxide,

N,N-dimethyl-N-myristylamine oxide, N,N-dimethyl-N-laurylamine oxide,

N,N-bis-(β-hydroxyethyl)-N-tallow-fatty amine oxide,

N,N-bis-(β-hydroxyethyl)-N-coconut-fatty amine oxide and

N,N-bis-(β-hydroxyethyl)-N-oleylamine oxide.

N,N-bis-(β-Hydroxyethyl)-N-oleylamine oxide, N,N-dimethyl-N-myristylamine oxide, N,N-dimethyl-N-laurylamine oxide, N,N-bis-(β-hydroxyethyl)-N-tallow-fatty amine oxide and N,N-bis-β-hydroxyethyl)-N-coconut-fatty amine oxide are preferred.

N,N-Dimethyl-N-myristylamine oxide and N,N-bis-(β-hydroxyethyl)-N-tallow-fatty amine oxide are particularly preferred.

The compounds of component (b) are, in particular, fatty alcohol glycol ethers of the formula $$R_4—O—(R_3—O)_m—W, \quad (2a)$$

in which $R_4$ is an aliphatic radical having 8 to 24 carbon atoms, in particular 8 to 18 carbon atoms, $R_3$ is alkylene having 2 to 4 carbon atoms, W is hydrogen or $C_1$–$C_6$alkyl which is unsubstituted or substituted by hydroxyl, carboxyl, isocyanato, phenyl, benzyloxymethylene or phenethyloxymethylene, m is a number from 2 to 25 and $(R_3—O)_m$ is m identical or different radicals $(R_3—O)$.

An aliphatic radical $R_4$ having 8 to 24 carbon atoms can be straight-chain or branched. Preferably, $R_4$ is alkyl or alkenyl having 8 to 22, in particular 8 to 18 carbon atoms. The aliphatic radicals can be present individually or in the form of mixtures of two or more components, for example mixtures of alkyl and/or alkenyl groups.

Aliphatic alkyl radicals having 8 to 18 carbon atoms are, for example, octyl, decyl, undecyl, dodecyl (lauryl), tetradecyl (myristyl), hexadecyl (cetyl), octadecyl (stearyl), 5-methylheptyl, 2-ethylhexyl, 1,1,3,3-tetramethylbutyl, isononyl, trimethylhexyl, trimethylnonyl or trimethyldecyl, or mixtures of linear primary alkyl radicals having 8 to 18 carbon atoms, such as $C_8$–$C_{10}$alkyl, $C_9$–$C_{11}$alkyl, $C_{10}$–$C_{14}$alkyl, $C_{12}$–$C_{13}$alkyl or $C_{16}$–$C_{18}$alkyl.

Examples of aliphatic alkenyl radicals are dodecenyl, hexadecenyl or octadecenyl (oleyl).

m is preferably a number from 4 to 15. m is particularly preferably a number from 8 to 10.

The compounds of the formula (2a) are known, for example, from EP-A-0 312 493.

The compounds of components (b) are furthermore fatty acid amide glycol ethers of the formula

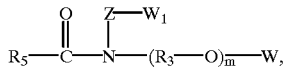

(2b)

in which $R_3$ is alkylene having 2 to 4 carbon atoms, $R_5$ is an aliphatic radical having 8 to 24 carbon atoms, in particular 8 to 18 carbon atoms, W and $W_1$ independently of one another are hydrogen or $C_1$–$C_6$alkyl which is unsubstituted or substituted by hydroxyl, carboxyl, isocyanato, phenyl, benzyloxymethylene or phenethyloxymethylene, Z is a direct bond, $(R_3—O)_r$ or $C_1$–$C_6$alkylene, m and r independently of one another are a number from 2 to 25, $(R_3—O)_m$ is m identical or different radicals $(R_3—O)$ and $(R_3—O)_r$ is r identical or different radicals $(R_3—O)$.

An aliphatic radical $R_5$ having 8 to 24 carbon atoms can be straight-chain or branched. Preferably, $R_5$ is alkyl or alkenyl having 8 to 22 and in particular 8 to 18 carbon atoms. The aliphatic radicals can be present individually or in the form of mixtures of two or more components, for example mixtures of alkyl and/or alkenyl groups. Aliphatic alkyl radicals having 8 to 24 carbon atoms are, for example, octyl, decyl, dodecyl (lauryl), tetradecyl (myristyl), hexadecyl (palmityl), octadecyl (stearyl), eicosanyl (arachinyl) and docosanyl (behenyl), 5-methylheptyl, 2-ethylhexyl, 1,1,3,3-tetramethylbutyl, isononyl, trimethylhexyl, trimethylnonyl or trimethyldecyl, or mixtures of linear primary alkyl radicals having 8 to 18 carbon atoms, such as $C_8$–$C_{10}$alkyl, $C_9$–$C_{11}$alkyl, $C_{10}$–$C_{14}$alkyl, $C_{12}$–$C_{13}$alkyl, or $C_{16}$–$C_{18}$alkyl. Examples of aliphatic alkenyl radicals are dodecenyl, tetradecenyl, hexadecenyl, octadecenyl (oleyl) or 9,12-octadienyl.

Suitable solvents for component (c) are, for example, water-miscible, organic polar solvents, for example monohydric and dihydric aliphatic $C_1$–$C_6$alcohols, such as methanol, ethanol, propanol, isopropanol, butanol, isobutanol, 1,3-butanediol or 1,2-pentanediol; alkylene glycols, such as ethylene glycol, propylene glycol or dipropylene glycol; monoalkyl ethers of glycols, such as ethylene glycol monomethyl ether, ethylene glycol monoethyl ether or ethylene glycol monobutyl ether, diethylene glycol monomethyl ether, diethylene glycol monoethyl ether, diethylene glycol monobutyl ether and tetraethylene glycol monobutyl ether; ketones, such as acetone, methyl ethyl ketone, cyclohexanone, diacetone-alcohol or 1-methyl-2-pyrrolidone; ethers and acetates, such as diisopropyl ether, diphenyl oxide, dioxane and tetrahydrofuran, and furthermore tetrahydrofurfuryl alcohol, pyridine, acetonitrile, y-butyrolactone, N,N-dimethylformamide, N,N-dimethylacetamide, tetramethylurea, tetramethylene sulfone, 2,2,4-trimethyl-1,3-pentanediol diisobutyrate or dimethyl methanephosphonate.

Methanol, ethanol, propanol, isopropanol, butanol, isobutanol, 1,3-butanediol, 1,2-pentanediol, ethylene glycol, propylene glycol, dipropylene glycol, ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, tetraethylene glycol monobutyl ether, γ-butyrolactone or tetramethylurea are preferably used as component (c).

The preparations according to the invention comprise 5 to 60 parts by weight, calculated per 100 parts by weight of the finished preparation, of component (c). The preparations according to the invention preferably comprise 10 to 50 parts by weight, calculated per 100 parts by weight of the finished preparation, of component (c). The preparations according to the invention particularly preferably comprise 10 to 30 parts by weight, calculated per 100 parts by weight of the finished preparation, of component (c).

The dyeing assistant preparation according to the invention can additionally comprise water as component (d).

Preferred dyeing assistant preparations are those which comprise, as component (a), N,N,-bis-(β-hydroxyethyl)-N-oleylamine oxide, N,N-dimethyl-N-myristylamine oxide, N,N-dimethyl-N-laurylamine oxide, N,N-bis-(β-hydroxyethyl)-N-tallow-fatty amine oxide and N,N-bis-(β-hydroxyethyl)-N-coconut-fatty amine oxide, as component (b), a fatty alcohol glycol ether of the formula $$C_{18}H_{35}—O—(CH_2—CH_2—O)_{2\text{-}25}H \quad (3a),$$

$$C_{18}H_{37}—O—(CH_2—CH_2—O)_{2\text{-}25}H \quad (3b)$$

or a mixture of the fatty alcohol glycol ethers of the formulae $$C_{16}H_{33}—O—(CH_2—CH_2—O)_{2\text{-}25}H \quad (3c)$$

and $$C_{18}H_{37}—O—(CH_2—CH_2—O)_{2\text{-}25}H \quad (3b)$$

or a coconut-fatty alcohol glycol ether having 2 to 25 added-on ethylene oxide units or a tallow-fatty alcohol glycol ether having 2 to 25 added-on ethylene oxide units, and, as component (c), an alkylene glycol or an aliphatic mono- or dihydric $C_1$–$C_6$alcohol.

Dyeing assistant preparations which are likewise preferred are those which comprise, as component (a), N,N-bis-(β-hydroxyethyl)-N-oleylamine oxide, N,N-dimethyl-N-myristylamine oxide, N,N-dimethyl-N-laurylamine oxide, N,N-bis-(β-hydroxyethyl)-N-tallow-fatty amine oxide and N,N-bis-(β-hydroxyethyl)-N-coconut-fatty amine oxide, as component (b), coconut-fatty acid monoethanolamide ethoxylate having 2 to 25 added-on ethylene oxide units, coconut-fatty acid diethanolamide ethoxylate having 2 to 25 added-on ethylene oxide units, tallow-fatty acid monoethanolamide ethoxylate having 2 to 25 added-on ethylene oxide units, tallow-fatty acid diethanolamide ethoxylate having 2 to 25 added-on ethylene oxide units, oleic acid monoethanolamide ethoxylate having 2 to 25 added-on ethylene oxide units or oleic acid diethanolamide ethoxylate having 2 to 25 added-on ethylene oxide units and, as component (c), an alkylene glycol or an aliphatic mono- or dihydric $C_1$–$C_6$alcohol.

Dyeing assistant preparations which are particularly preferred are those which comprise, as component (a), N,N-dimethyl-N-myristylamine oxide or N,N-bis-(β-hydroxyethyl)-N-tallow-fatty amine oxide, as component (b), fatty alcohol glycol ethers of the formula $$C_{18}H_{35}—O—(CH_2—CH_2—O)_{10}H \quad (4c),$$

or a mixture of the fatty alcohol glycol ethers of the formulae $$C_{16}H_{33}—O—(CH_2—CH_2—O)_8H \quad (4c)$$

and $$C_{18}H_{37}—O—(CH_2—CH_2—O)_8H \quad (4b)$$

or a coconut-fatty alcohol glycol ether having 8 added-on ethylene oxide units or a tallow-fatty alcohol glycol ether having 8 added-on ethylene oxide units, and, as component (c), an alkylene glycol or an aliphatic mono- or dihydric $C_1$–$C_6$alcohol.

Dyeing assistant preparations which are likewise particularly preferred are those which comprise, as component (a), N,N-dimethyl-N-myristylamine oxide or N,N-bis-(β-hydroxyethyl)-N-tallow-fatty amine oxide, as component (b), an oleic acid diethanolamide ethoxylate having 14 added-on ethylene oxide units or an oleic acid monoethanolamide ethoxylate having 14 added-on ethylene oxide units, and, as component (c), an alkylene glycol or an aliphatic mono- or dihydric $C_1$–$C_6$alcohol.

The compounds of component (b) corresponding to formula (2) are known and can be prepared by known processes; for example by adding 2 to 25 mol of ethylene oxide onto aliphatic alcohols which contain an aliphatic radical having 8 to 24 carbon atoms, or onto fatty acids which contain an aliphatic radical having 8 to 24 carbon atoms, and if appropriate reacting the addition product with a compound which introduces the substituent W.

The compounds which are required as starting substances for the preparation of the compounds of the formulae (2), (2a), (2b), (3a) to (3c) and (4a) to (4c) can be saturated or unsaturated, branched or unbranched fatty alcohols, fatty acids or fatty acid amides having 8 to 24, preferably 8 to 18 carbon atoms. They can be chemically uniform or present in the form of mixtures. Mixtures which are preferably used are those such as are formed in the conversion of naturally occurring fats or oils, for example, tallow fat or soya or coconut oil, into the corresponding alcohols or fatty acids.

The weight ratio of components (a) and (b) is between 1:10 and 10:1, in particular between 2:5 and 5:2, especially between 2:3 and 3:2.

Preferred dyeing assistant preparations are those comprising the compound of the formula (1) as component (a) and the compound of the formula (2a) as component (b) in a weight ratio of between 2:3 and 3:2.

Dyeing assistant preparations which are likewise preferred are those comprising the compound of the formula (1) as component (a) and compound of the formula (2b) as component (b) in a weight ratio of 3:2.

Dyeing assistant preparations which are particularly preferred are those comprising an N,N-bis-(β-hydroxyethyl)-N-tallow-fatty amine acid as component (a) and an oleyl alcohol ethoxylate having 10 added-on ethylene oxide units as component (b) in a weight ratio of 2:3.

Dyeing assistant preparations which are likewise particularly preferred are those comprising an N,N-bis-(β-hydroxyethyl)-N-tallow-fatty amine oxide as component (a) and a stearyl alcohol ethoxylate having 8 added-on ethylene oxide units as component (b) in a weight ratio of 3:2.

Dyeing assistant preparations which are furthermore particularly preferred are those comprising an N,N-bis-(β-hydroxyethyl)-N-tallow-fatty amine oxide as component (a) and an oleic acid monoethanolamide ethoxylate having 14 added-on ethylene oxide units as component (b) in a weight ratio of 3:2.

In the preparation of the dyeing assistant preparations according to the invention, components (a), (b) and (c) and if appropriate (d) are mixed together in any sequence by simple stirring at room temperature. They are advantageously mixed together at a temperature between 20 and 40° C.

The present invention also relates to the use of the dyeing assistant preparations according to the invention as dyeing assistants for dyeing wool. The wool can be in various made-up forms. The following are suitable, for example: flock, slubbing, yarn, woven fabric, knitted goods or carpets. The wool can be normal or have a non-felting finish. The dyeing assistant preparations according to the invention are preferably used as levelling assistants.

The amounts in which the dyeing assistant preparation comprising components (a), (b) and (c) is added to the dyebath for use vary between 0.1 and 10 per cent by weight, based on the weight of the wool material to be dyed. 0.2 to 5 per cent by weight of the dyeing assistant preparation, based on the weight of the wool material to be dyed, is preferably used. 1 to 3 per cent by weight of the dyeing assistant preparation, based on the weight of the wool material to be dyed, is particularly preferably used.

The dyeing assistant preparations according to the invention are distinguished by easy handling and problem-free incorporation into the dyebath, for example by direct addition with moderate stirring. They can be prepared and stored in the form of stable stock solutions which have a long shelf life without precipitations. The dyeing assistant preparation according to the invention can be applied by an exhaust method before or during dyeing. Application before dyeing is preferred.

The customary dyes which are suitable for dyeing wool can be used for dyeing wool with the aid of the preparations according to the invention.

Reactive dyes are preferably used. This class of dye is called "Reactive Dyes" in the Colour Index 3, 1971 edition. They are chiefly those dyes which contain at least one group which is capable of reaction with polyhydroxyl fibres (cellulose fibres) or polyamide fibres, in particular wool, a precursor of this group or a substituent which is capable of reaction with polyhydroxyl fibres or polyamide fibres.

Suitable parent substances for reactive dyes are, in particular, those from the series consisting of mono-, dis- or polyazo dyes, including formazan dyes, and the anthraquinone, xanthene, nitro, triphenylmethane, naphthoquinonimine, dioxazine and phthalocyanine dyes, where the azo and phthalocyanine dyes can either be metal-free or contain metal.

Reactive groups and precursors which form such reactive groups are, for example, epoxy groups, the ethylenimide group, the vinyl grouping in vinylsulfone or acrylic acid radical and the β-sulfatoethylsulfone group, the β-chloroethylsulfone group or the β-dialkylaminoethylsulfone group.

Reactive substituents in reactive dyes are those which can easily be split off and leave behind an electrophilic radical.

Such substituents are, for example, 1 or 2 halogen atoms in an aliphatic acyl radical, for example in the β-position or α- and β-position of a propionyl radical or in the α- and/or β-position of an acrylic acid radical, or 1 to 3 halogen atoms on the following ring systems: pyridazine, pyrimidine, pyridazone, triazine, quinoxaline or phthalazine.

Dyes with two or more identical or different reactive groups can also be used.

Preferred reactive dyes contain chloroacetyl, bromoacryl or dibromopropionyl as reactive substituents.

The reactive dyes can contain acid salt-forming substituents, for example carboxylic acid groups, sulfuric acid and phosphonic acid ester groups, phosphonic acid groups or, preferably, sulfonic acid groups.

Preferred reactive dyes are those having at least one sulfonic acid group, in particular reactive dyes having an azo or anthraquinone parent structure which preferably contains two to three sulfonic acid groups.

Mixtures of reactive dyes can also be used, in which case dichromatic or trichromatic dyeings can be produced.

1:1 chromium complex azo dyes of the formula (5)

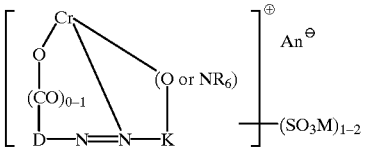

in which —$(CO)_{0-1}$—O— and (O or $NR_6$) are bonded to D and K in the position adjacent to the azo bridge, D is the radical of a diazo component of the benzene or naphthalene series, K is the radical of a coupling component of the benzene, naphthalene or heterocyclic series or of the acetoacetic acid arylide series, $R_6$ is hydrogen or a substituted or unsubstituted alkyl or phenyl radical, M is hydrogen or an alkali metal cation and An is an anion are also preferably used.

1:1 chromium complex azo dyes which are particularly preferably used are those of the formula (5) in which D is a benzene or naphthalene radical which is unsubstituted or substituted by halogen, $C_1$–$C_4$alkyl, $C_1$–$C_4$alkoxy, nitro or sulfamoyl, K is a phenyl, naphthyl, 1-phenyl-3-methylpyrazol-5-one, acetoacetamide, in particular acetoacetoanilide, or quinoline radical which is unsubstituted or substituted by halogen, $C_1$–$C_4$allyl, $C_1$–$C_4$alkoxy, $C_2$–$C_4$alkanoylamino, sulfamoyl or hydroxyl, $R_6$ is hydrogen and M is an alkali metal cation.

Mixtures of the 1:1 chromium complex azo dyes can also be used.

The dyes used are known and can be prepared by known methods.

Dyeing is carried out by the exhaust method. The amount of dyes added to the dye liquor depends on the desired tinctorial strength. Amounts of 0.01 to 10 per cent by weight, preferably 0.01 to 4 per cent by weight, based on the weight of fibre material employed, have in general proved suitable.

The liquor ratio can be chosen within a wide range, for example 1:3 to 1:100, preferably 1:8 to 1:30.

The dyebaths can comprise mineral acids, for example sulfuric acid or phosphoric acid, organic acids, advantageously aliphatic carboxylic acids, such as formic acid, acetic acid, oxalic acid or citric acid, and/or salts, such as ammonium acetate, ammonium sulfate or sodium acetate. The acids serve in particular to adjust the pH of the liquors used according to the invention, which is between 4 and 5.5.

The dye liquors can also comprise other additives, for example wool protection agents, dispersants and wetting agents, and also antifoams.

The dyeing process can be carried out in the customary dyeing apparatuses, for example open baths, slubbing, hank yarn or pack dyeing apparatuses, jigger or paddle apparatuses, beam dyeing apparatuses, circulatory or jet dyeing apparatuses or winch becks.

Dyeing is advantageously carried out at a temperature in the range from 40 to 120° C., preferably 70 to 105° C. The dyeing time is within the usual framework and is as a rule 20 to 120 minutes.

When dyeing has ended, the dyeing process can be followed by an alkaline after treatment, for example with aqueous ammonia, alkali metal hydroxides, alkali metal carbonates or bicarbonates or hexamethylenetetramine. The pH of the dyebaths comprising alkali is advantageously 7.5 to 9, preferably 8 to 8.5.

Dyeing of the fibre material is advantageously carried out by a procedure in which the goods to be dyed are treated briefly with an aqueous liquor which comprises the dyeing assistant preparation according to the invention comprising components (a), (b) and (c) and has a temperature of 30 to 60° C. and the reactive dye is added to the same bath. The temperature is then increased slowly, in order to carry out dyeing in a range from 80 to 100° C. for 20 to 90 minutes, preferably 30 to 60 minutes. The dyed goods, if required after addition of alkalis, preferably ammonia, sodium bicarbonate or sodium carbonate, are then either treated in the same dyebath at 70 to 90° C. for a further 10 to 20 minutes, or, preferably, the dyebath is drained off and this subsequent treatment is carried out in a fresh bath. Finally, the dyed material is removed and rinsed, acidified and dried in the customary manner.

If dyeing assistant preparations according to the invention are used, dyeings which are level over the fibre and surface and have good lightfastness and wet fastness properties are obtained.

The following examples serve to illustrate the invention. In these, parts and percentages are by weight. The temperatures are stated in degrees Celsius. Parts by weight bear the same relation to the parts by volume as the gramme to the cubic centimeter.

EXAMPLE 1

A worsted spun yarn cheese of 1200 g having a bobbin compactness of 350 g/l is treated in a ®MTM-Obermeier circulatory dyeing apparatus with a liquor comprising 12 g of a dyeing assistant preparation comprising
- 22 per cent by weight of an N,N-bis-(β-hydroxyethyl)-N-tallow-fatty amine oxide,
- 33 per cent by weight of a fatty alcohol glycol ether of the formula $C_{18}H_{35}$—O—$(CH_2$—$CH_2$—O$)_{10}$H,
- 20 per cent by weight of 2-methyl-2,4-pentanediol and
- 25 per cent by weight of water, 0.5 g/l of a commercially available penetration accelerator, 48 g of ammonium sulfate and 60 g of calcined sodium sulfate at a liquor ratio of 1:20 and an inner/outer liquor circulation of 36 l/minute, at 50° C. for 10 minutes. 5.4 g of the yellow dye of the formula (10)

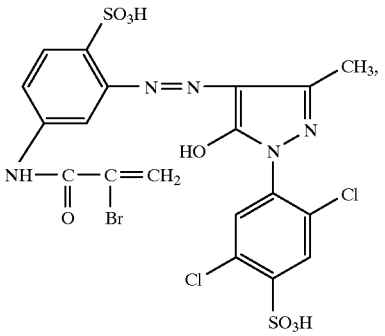

7.2 g of the red dye of the formula (11)

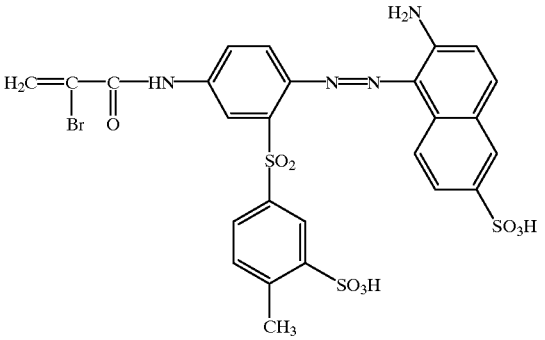

and 5.4 g of the blue dye of the formula (12)

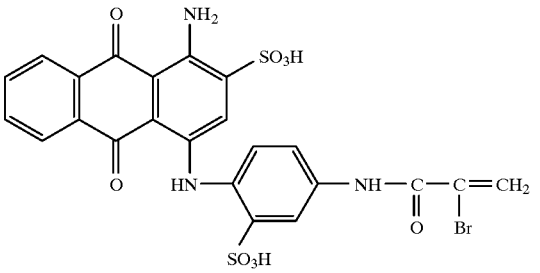

are then added to the liquor.

After a further 10 minutes, the pH of the liquor is brought to 5.5 with 80% acetic acid and the temperature is increased to 70° C. in the course of 20 minutes. After 20 minutes, the temperature is increased to 98° C. in the course of 30 minutes and is kept at this level for 45 minutes. The liquor is then cooled to 80° C. and drained off. The dyed cheese is further treated in a fresh bath with 25 l of water, which is brought to a pH of 8.5 with ammonia, at 80° C. for 15 minutes. The cheese is then rinsed, neutralized with formic acid and dried. A level brown dyeing for which the inside and outside of the cheese shows no difference in colour is obtained.

EXAMPLE 1a

The procedure described in Example 1 is repeated, using, instead of 12 g of a dyeing assistant preparation comprising 22 per cent by weight of an N,N-bis-(β-hydroxyethyl)-N-tallow-fatty amine oxide, 33 per cent by weight of a fatty alcohol glycol ether of the formula $C_{18}H_{35}$—O—($CH_2$—$CH_2$—O)$_{10}$H, 20 per cent by weight of 2-methyl-2,4-pentanediol and 25 per cent by weight of water, 12 g of a dyeing assistant preparation comprising 22 per cent by weight of an N,N-bis-(β-hydroxyethyl)-N-tallow-fatty amine oxide, 33 per cent by weight of the formula $C_{18}H_{35}$—O—($CH_2$—$CH_2$—O)$_{10}$H, p2 34 per cent by weight of 2-methyl-2,4-pentanediol and 11 per cent by weight of diethylene glycol.

A level brown dyeing with which the inside and outside of the cheese show no difference in colour is likewise obtained.

EXAMPLE 2

In an ®AHIBA dyeing apparatus, at a liquor ratio of 1:13, a sample of 45 g of woollen serge is treated with a liquor comprising 0.45 g of a dyeing assistant preparation comprising 21 per cent by weight of an N,N-dimethyl-N-myristylamine oxide, 14 per cent by weight of a $C_{16}/C_{18}$ fatty alcohol glycol ether having 8 added-on ethylene oxide units, 16 per cent by weight of 2-methyl-2,4-pentanediol and 49 per cent by weight of water, 0.5 g/l of a commercially available penetration accelerator, 1.8 g of ammonium sulfate and 2.25 g of calcined sodium sulfate as follows.

The liquor is heated to 50° C. and the woollen serge sample is treated at this temperature for 10 minutes.

0.675 g of the red dye of the formula (13)

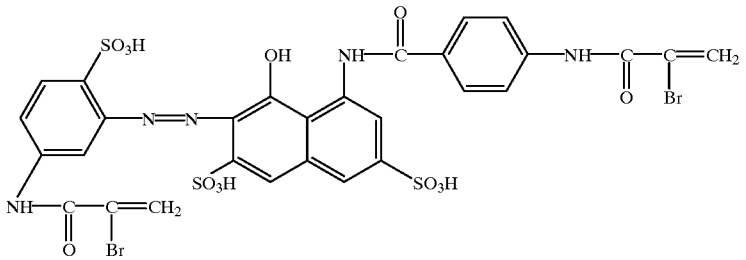

is then added to the liquor. After a further 10 minutes, the pH is brought to 5.5 with 80% acetic acid and the temperature is increased to 70° C. in the course of 20 minutes. After 20 minutes, the temperature is increased to 98° C. in the course of 30 minutes and is kept at this level for 45 minutes. The liquor is then cooled to 80° C. and drained off. The dyed woollen serge sample is further treated in a fresh bath with 150 ml of water, which is brought to a pH of 8.5 with ammonia, at 80° C. for 15 minutes. The dyed woollen serge sample is then rinsed, neutralized with formic acid and dried. A level red dyeing is obtained.

EXAMPLE 2a

The procedure described in Example 2 is repeated, using, instead of 0.45 g of a dyeing assistant preparation comprising 21 per cent by weight of an N,N-dimethyl-N-myristylamine oxide, 14 per cent by weight of a $C_{16}/C_{18}$ fatty alcohol glycol ether having 8 added-on ethylene oxide units,
16 per cent by weight of 2-methyl-2,4-pentanediol and
49 per cent by weight of water, the same amount of a dyeing assistant preparation comprising
22 per cent by weight of an N,N-bis-(β-hydroxyethyl)-N-tallow-fatty amine oxide,
33 per cent by weight of $C_{18}H_{35}$—O—($CH_2$—$CH_2$—O)$_{10}$H,
34 per cent by weight of 2-methyl-2,4-pentanediols and
11 per cent by weight of diethylene glycol.

A level red dyeing is likewise obtained.

EXAMPLE 3

The procedure described in Example 2 is repeated, using, instead of 0.45 g of a dyeing assistant preparation comprising
21 per cent by weight of an N,N-dimethyl-N-myristylamine oxide,
14 per cent by weight of a $C_{16}/C_{18}$ fatty alcohol glycol ether having 8 added-on ethylene oxide units,
16 per cent by weight of 2-methyl-2,4-pentanediol and
49 per cent by weight of water, 0.45 g of a dyeing assistant preparation comprising
22 per cent by weight of an N,N-bis-(β-hydroxyethyl)-N-tallow-fatty amine oxide,
33 per cent by weight of a fatty alcohol glycol ether of the formula $C_{18}H_{35}$—O—($CH_2$—$CH_2$—O)$_{10}$H,
20 per cent by weight of 2-methyl-2,4-pentanediol and
25 per cent by weight of water.

A level red dyeing is likewise obtained.

EXAMPLE 4

The procedure described in Example 2 is repeated, using, instead of 0.45 g of a dyeing assistant preparation comprising
21 per cent by weight of an N,N-dimethyl-N-myristylamine oxide,
14 per cent by weight of a $C_{16}/C_{18}$ fatty alcohol glycol ether having 8 added-on ethylene oxide units,
16 per cent by weight of 2-methyl-2,4-pentanediol and
49 per cent by weight of water, 0.45 g of a dyeing assistant preparation comprising
30 per cent by weight of an N,N-bis-(β-hydroxyethyl)-N-tallow-fatty amine oxide,
20 per cent by weight of a $C_{16}/C_{18}$ fatty alcohol glycol ether having 8 added-on ethylene oxide units,
20 per cent by weight of 2-methyl-2,4-pentanediol and
30 per cent by weight of water.

A level red dyeing is likewise obtained.

EXAMPLE 5

The procedure described in Example 2 is repeated, using, instead of 0.45 g of a dyeing assistant preparation comprising
21 per cent by weight of an N,N-dimethyl-N-myristylamine oxide,
14 per cent by weight of a $C_{16}/C_{18}$ fatty alcohol glycol ether having 8 added-on ethylene oxide units,
16 per cent by weight of 2-methyl-2,4-pentanediol and
49 per cent by weight of water, 0.45 g of a dyeing assistant preparation comprising
30 per cent by weight of an N,N-bis-(β-hydroxyethyl)-N-tallow-fatty amine oxide,
20 per cent by weight of an oleic acid monoethanolamide ethoxylate having 14 added-on ethylene oxide units,
20 per cent by weight of 2-methyl-2,4-pentanediol and
30 per cent by weight of water.

A level red dyeing is likewise obtained.

EXAMPLE 6

The procedure described in Examples 2 to 5 is repeated, using, instead of a sample of 45 g of woollen serge, a sample of the same weight of wool which tends to give skittery dyeings. Level red dyeings are likewise obtained.

EXAMPLE 7

In an ®AHIBA dyeing apparatus, at a liquor ratio of 1:13, a sample of 45 g of woollen serge is treated with a liquor comprising 0.8 g of a dyeing assistant preparation comprising
22 per cent by weight of an N,N-bis-(β-hydroxyethyl)-N-tallow-fatty amine oxide
33 per cent by weight of a fatty alcohol glycol ether of the formula $C_{18}H_{35}$—O—($CH_2$—$CH_2$—O)$_{10}$H,
20 per cent by weight of 2-methyl-2,4-pentanediol and
25 per cent by weight of water, 0.5 g/l of a commercially available penetration accelerator, 20 ml of 85% formic acid, 3.6 g of calcined sodium sulfate, 0.07 g of hexafluorosilicate, 0.04 g of the dye of the formula (14)

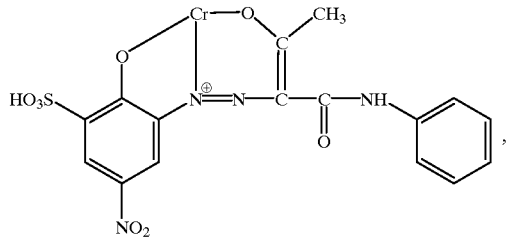

, 0.08 g of the dye of the formula (15)

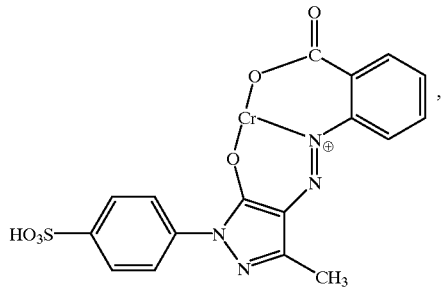

, 0.04 g of the dye of the formula (16)

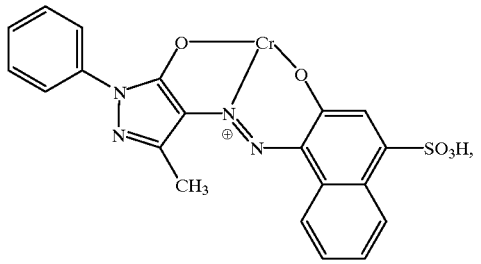

0.14 g of the dye of the formula (17)

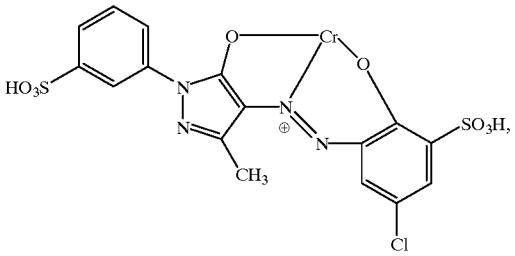

0.24 g of the dye of the formula (18)

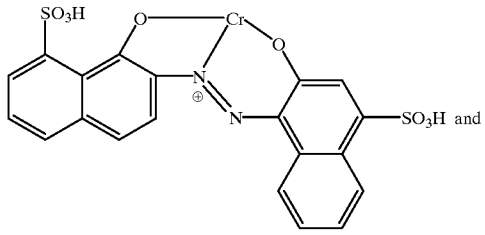

0.26 g of the dye of the formula (19)

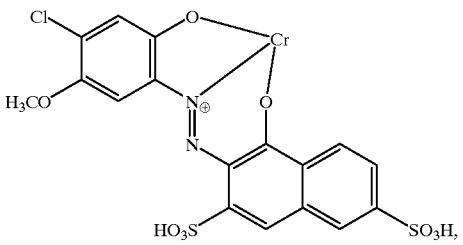

as follows.

The liquor is heated to 40° C. and the woollen serge sample is added and treated at this temperature for 20 minutes. The temperature of the dyebath is then increased to 98° C. in the course of 60 minutes and kept at this temperature for 90 minutes. The dyebath is then cooled to 80° C. and the woollen serge sample is removed, rinsed with running water heated at 40° C. and dried. A level dark grey dyeing is obtained.

What is claimed is:

1. A method of dyeing wool, which comprises dyeing wool in a dyebath which contains, based on the weight of the wool material to be dyed, 0.1 to 10 percent by weight of a dyeing assistant preparation, which preparation comprises, (a), at least one amine oxide of the formula

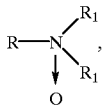

(1)

in which

R is an aliphatic radical having 8 to 24 carbon atoms and $R_1$ is an aliphatic radical which is unsubstituted or substituted by hydroxyl and has 1 to 24 carbon atoms, (b), at least one compound of the formula $$R_2—U—(R_3—O)_m—W, \quad (2)$$

in which $R_2$ is an aliphatic radical having 8 to 24 carbon atoms, $R_3$ is alkylene having 2 to 4 carbon atoms, U is —O— or

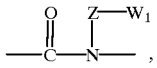

in which Z is a direct bond, $(R_3—O)_r$ or $C_1$–$C_6$alkylene and $W_1$ is hydrogen or $C_1$–$C_6$alkyl which is unsubstituted or substituted by hydroxyl, carboxyl, isocyanato, phenyl, benzyloxymethylene or phenethyloxymethylene, m and r independently of one another are a number from 2 to 25, $(R_3—O)_m$ is m identical or different radicals $(R_3—O)$, and $(R_3—O)_r$ is r identical or different radicals $(R_3—O)$, and W is hydrogen or $C_1$–$C_6$alkyl which is unsubstituted or substituted by hydroxyl, carboxyl, isocyanato, phenyl, benzyloxymethylene or phenethyloxymethylene, and, (c), an organic solvent selected from the group consisting of methanol, ethanol, propanol, isopropanol, butanol, isobutanol, 1,3-butanediol, 1,2-pentanediol, ethylene glycol, propylene glycol, dipropylene glycol, ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, tetraethylene glycol monobutyl ether, acetone, methyl ethyl ketone, cyclohexanone, diacetone-alcohol, 1-methyl-2-pyrrolidone, diisopropyl ether, diphenyl oxide, dioxane, tetrahydrofuran, tetrahydrofurfuryl alcohol, pyridine, acetonitrile, γ-butyrolactone, N,N-dimethylformamide, N,N-dimethylacetamide, tetramethylurea, tetramethylene sulfone, 2,2,4-trimethyl-1,3-pentanediol diisobutyrate and dimethyl methanephosphonate.

2. The method according to claim 1, wherein the component (a) is at least one amine oxide selected from the group consisting of N,N-dimethyl-N-hexadecylamine oxide, N,N-dimethyl-N-octadecenylamine oxide, N,N-dibutyl-N-dodecylamine oxide, N,N-bis-(β-hydroxyethyl)-N-stearylamine oxide, N,N-dimethyl-N-oleylamine oxide, N,N-dimethyl-N-myristylamine oxide, N,N-dimethyl-N-laurylamine oxide, N,N-bis-(β-hydroxyethyl)-N-tallow-fatty amine oxide, N,N-bis-(β-hydroxyethyl)-N-coconut-fatty amine oxide and N,N-bis-(β-hydroxyethyl)-N-oleylamine oxide.

3. The method according to claim 1, wherein the component (b) is a fatty alcohol glycol ether of the formula $$R_4—O—(R_3—O)_m—W \quad (2a),$$

in which $R_4$ is an aliphatic radical having 8 to 24 carbon atoms, $R_3$ is alkylene having 2 to 4 carbon atoms, W is hydrogen or $C_1$–$C_6$alkyl which is unsubstituted or substituted by hydroxyl, carboxyl, isocyanato, phenyl, benzyloxymethylene or phenethyloxymethylene, m is a number from 2 to 25 and $(R_3—O)_m$ is m identical or different radicals $(R_3—O)$.

4. The method according to claim 1, wherein the component (b) is a fatty alcohol glycol ether of the formula (2b)

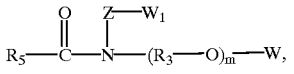

in which $R_5$ is an aliphatic radical having 8 to 24 carbon atoms, $R_3$ is alkylene having 2 to 4 carbon atoms, W and $W_1$ independently of one another are hydrogen or $C_1$–$C_6$alkyl which is unsubstituted or substituted by hydroxyl, carboxyl, isocyanato, phenyl, benzyloxymethylene or phenethyloxymethylene, Z is a direct bond, $(R_3—O)_r$ or $C_1$–$C_6$alkylene, m and r independently of one another are a number from 2 to 25, $(R_3—O)_m$ is m identical or different radicals $(R_3—O)$ and $(R_3—O)_r$ is r identical or different radicals $(R_3—O)$.

5. The method according to claim 1, wherein the dyeing assistant preparation is used for dyeing wool with reactive or 1:1 chromium complex azo dyes.

6. The method according to claim 1, wherein the component (c) is an organic solvent selected from the group consisting of methanol, ethanol, propanol, isopropanol, butanol, isobutanol, 1,3-butanediol, 1,2-pentanediol, ethylene glycol, propylene glycol, dipropylene glycol, ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, tetraethylene glycol monobutyl ether, γ-butyrolactone and tetramethylurea.

7. The method according to claim 1, wherein the dyeing assistant preparation further comprises water as component (d).

8. The method according to claim 1, wherein the component (a) is an amine oxide selected from the group consisting of N,N-bis-(β-hydroxyethyl)-N-oleylamine oxide, N,N-dimethyl-N-myristylamine oxide, N,N-dimethyl-N-laurylamine oxide, N,N-bis-(β-hydroxyethyl)-N-tallow-fatty amine oxide and N,N-bis-(β-hydroxyethyl)-N-coconut-fatty amine oxide, the component (b) is a compound selected from the group consisting of a fatty alcohol glycol ether of the formula $$C_{18}H_{35}—O—(CH_2—CH_2—O)_{2\text{-}25}H \quad (3a),$$

$$C_{18}H_{37}—O—(CH_2—CH_2—O)_{2\text{-}25}H \quad (3b),$$

a mixture of the fatty alcohol glycol ethers of the formulae $$C_{16}H_{33}—O—(CH_2—CH_2—O)_{2\text{-}25}H \quad (3c)$$

and $$C_{18}H_{35}—O—(CH_2—CH_2—O)_{2\text{-}25}H \quad (3b),$$

a coconut-fatty alcohol glycol ether having 2 to 25 added-on ethylene oxid units and a tallow-fatty alcohol glycol ether having 2 to 25 added-on ethylene oxide units, and, the component (c) is an alkylene glycol selected from the group consisting of ethylene glycol, propylene glycol and dipropylene glycol or an aliphatic mono- or dihydric $C_1$–$C_6$alcohol selected from the group consisting of methanol, ethanol, propanol, isopropanol, butanol, isobutanol, 1,3-butanediol und 1,2-pentanediol.

9. The method according to claim 1, wherein the component (a) is an amine oxide selected from the group consisting of N,N-bis-(β-hydroxyethyl)-N-oleylamine oxide, N,N-dimethyl-N-myristylamine oxide, N,N-dimethyl-N-laurylamine oxide, N,N-bis-(β-hydroxyethyl)-N-tallow-fatty amine oxide and N,N-bis-(β-hydroxyethyl)-N-coconut-fatty amine oxide, the component (b) is a compound selected from the group consisting of coconut-fatty acid monoethanolamide ethoxylate having 2 to 25 added-on ethylene oxide units, coconut-fatty acid diethanolamide ethoxylate having 2 to 25 added-on ethylene oxide units, tallow-fatty acid monoethanolamide ethoxylate having 2 to 25 added-on ethylene oxide units, tallow-fatty acid diethanolamide ethoxylate having 2 to 25 added-on ethylene oxide units, oleic acid monoethanolamide ethoxylate having 2 to 25 added-on ethylene oxide units and oleic acid diethanolamide ethoxylate having 2 to 25 added-on ethylene oxide units and the component (c) is an alkylene glycol selected from the group consisting of ethylene glycol, propylene glycol and dipropylene glycol or an aliphatic mono- or dihydric $C_1$–$C_6$alcohol selected from the group consisting of methanol, ethanol, propanol, isopropanol, butanol, isobutanol, 1,3-butanediol und 1,2-pentanediol.

10. The method according to claim 1, wherein the weight ratio of components (a) and (b) in the dyeing assistant preparation is between 1:10 and 10:1.

11. A method according to claim 3, which comprises the compound of the formula (1) as component (a) and the compound of the formula (2b) as component (b) in a weight ratio of 2:3 to 3:2.

12. A method according to claim 4, which comprises the compound of the formula (1) as component (a) and the compound of the formula (2b) as component (b) in a weight ratio of 3:2.

* * * * *